US010738437B1

(12) United States Patent
Allen et al.

(10) Patent No.: US 10,738,437 B1
(45) Date of Patent: Aug. 11, 2020

(54) TANK WALL

(71) Applicant: Dutchland, Inc., Gap, PA (US)

(72) Inventors: Joshua C. Allen, Lititz, PA (US); Ken Sullivan, Gap, PA (US)

(73) Assignee: Dutchland, Inc., Gap, PA (US)

( * ) Notice: Subject to any disclaimer, the term of this patent is extended or adjusted under 35 U.S.C. 154(b) by 0 days.

(21) Appl. No.: 16/387,955

(22) Filed: Apr. 18, 2019

(51) Int. Cl.
*E02D 29/02* (2006.01)
*E04C 2/38* (2006.01)
*E04C 2/04* (2006.01)

(52) U.S. Cl.
CPC ..... *E02D 29/0266* (2013.01); *E02D 29/0275* (2013.01); *E04C 2/044* (2013.01); *E04C 2/382* (2013.01)

(58) Field of Classification Search
CPC . E02D 29/02; E02D 29/0266; E02D 29/0275; E04B 1/04; E04B 1/046; E04B 2001/3276; E04C 2/044; E04C 2/06; E04C 2/382
See application file for complete search history.

(56) References Cited

U.S. PATENT DOCUMENTS 2,351,856 A * 6/1944 Henderson ..... E04B 1/215 52/206
3,195,312 A 7/1965 Rumsey, Jr.
3,331,181 A * 7/1967 Schmidt ..... E04B 7/107 52/745.06
3,464,211 A * 9/1969 Andresen ..... E02D 29/0266 405/262
3,869,530 A * 3/1975 Williams ..... E04C 5/165 264/33
4,290,246 A 9/1981 Hilsey
4,559,881 A * 12/1985 Lankard ..... B28B 23/00 106/644
7,614,830 B1 11/2009 Ritke
10,053,833 B2 8/2018 Baumgartner et al.
2002/0069602 A1* 6/2002 Blanchet ..... E04B 1/04 52/600

(Continued)

FOREIGN PATENT DOCUMENTS

GB 751652 7/1956
JP 4325203 A 11/1992

OTHER PUBLICATIONS

Abstract of JP04325203, dated Nov. 13, 1992, 1 page.

*Primary Examiner* — Carib A Oquendo
(74) *Attorney, Agent, or Firm* — Barley Snyder

(57) ABSTRACT

A tank wall comprises a concrete body, a plurality of reinforcement elements disposed in the concrete body, and a plurality of attachment elements disposed in the concrete body. The concrete body has a top surface, a bottom surface opposite the top surface in a vertical direction, a flat surface extending in the vertical direction between the top surface and the bottom surface, and a tapered surface disposed opposite the flat surface. The flat surface extends perpendicular to the bottom surface and a portion of the tapered surface extends at an acute angle with respect to the bottom surface. The reinforcement elements include a plurality of reinforcement strands and a plurality of monostrand anchors between which the reinforcement strands are attached. The attachment elements include a plurality of U-shaped bars extending through the top surface of the concrete body.

30 Claims, 9 Drawing Sheets

(56) References Cited

U.S. PATENT DOCUMENTS

| | | | | |
|---|---|---|---|---|
| 2006/0037278 | A1* | 2/2006 | Crane | E04H 7/18 52/745.01 |
| 2010/0154318 | A1 | 6/2010 | Shockley et al. | |
| 2015/0266615 | A1* | 9/2015 | Kriegstein | B65D 21/0235 206/205 |
| 2016/0160491 | A1* | 6/2016 | Ladret | E04B 1/043 52/223.6 |
| 2016/0356045 | A1* | 12/2016 | Fenske | E04B 1/4107 |
| 2016/0362890 | A1 | 12/2016 | Burke | |
| 2017/0037623 | A1* | 2/2017 | Sorkin | B28B 23/046 |
| 2018/0355576 | A1* | 12/2018 | Baumgartner | E02D 29/0266 |

* cited by examiner

TANK WALL

FIELD OF THE INVENTION

The present invention relates to a tank wall and, more particularly, to a concrete tank wall of a retaining tank.

BACKGROUND

Concrete walls are commonly used to form retention structures, such as a tank used for retaining wastewater. Casting concrete structures in place can be expensive due to the equipment required and the transportation of the equipment to the build site. Each of the concrete walls of the tank can alternatively be precast at or away from the build site of the tank, shipped to or moved on the build site, and assembled at the build site at a reduced cost and increased quality compared to casting in place at the build site.

Each of the precast concrete walls is dimensioned as necessary to retain the retained material, such as the wastewater, in the particular application of the retention structure. A height of the precast concrete wall is dictated by a desired height of the retention structure. A thickness of the wall is dictated by a maximum necessary retention strength of the concrete wall.

As the thickness and height requirements of each concrete wall increase, more concrete is required to build the overall retention structure. Further, when the concrete is precast off-site and shipped to the build site, shipping costs to the build site are a significant barrier to production and efficiency for precast concrete walls and are limited by an overall weight. In shipment applications, a width of the concrete wall is limited by the maximum overall weight, requiring more concrete walls to construct the retention structure and requiring more shipments. Each of these factors increases the cost of building a retention structure with concrete walls.

SUMMARY

A tank wall comprises a concrete body, a plurality of reinforcement elements disposed in the concrete body, and a plurality of attachment elements disposed in the concrete body. The concrete body has a top surface, a bottom surface opposite the top surface in a vertical direction, a flat surface extending in the vertical direction between the top surface and the bottom surface, and a tapered surface disposed opposite the flat surface. The flat surface extends perpendicular to the bottom surface and a portion of the tapered surface extends at an acute angle with respect to the bottom surface. The reinforcement elements include a plurality of reinforcement strands and a plurality of monostrand anchors between which the reinforcement strands are attached. The attachment elements include a plurality of U-shaped bars extending through the top surface of the concrete body.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
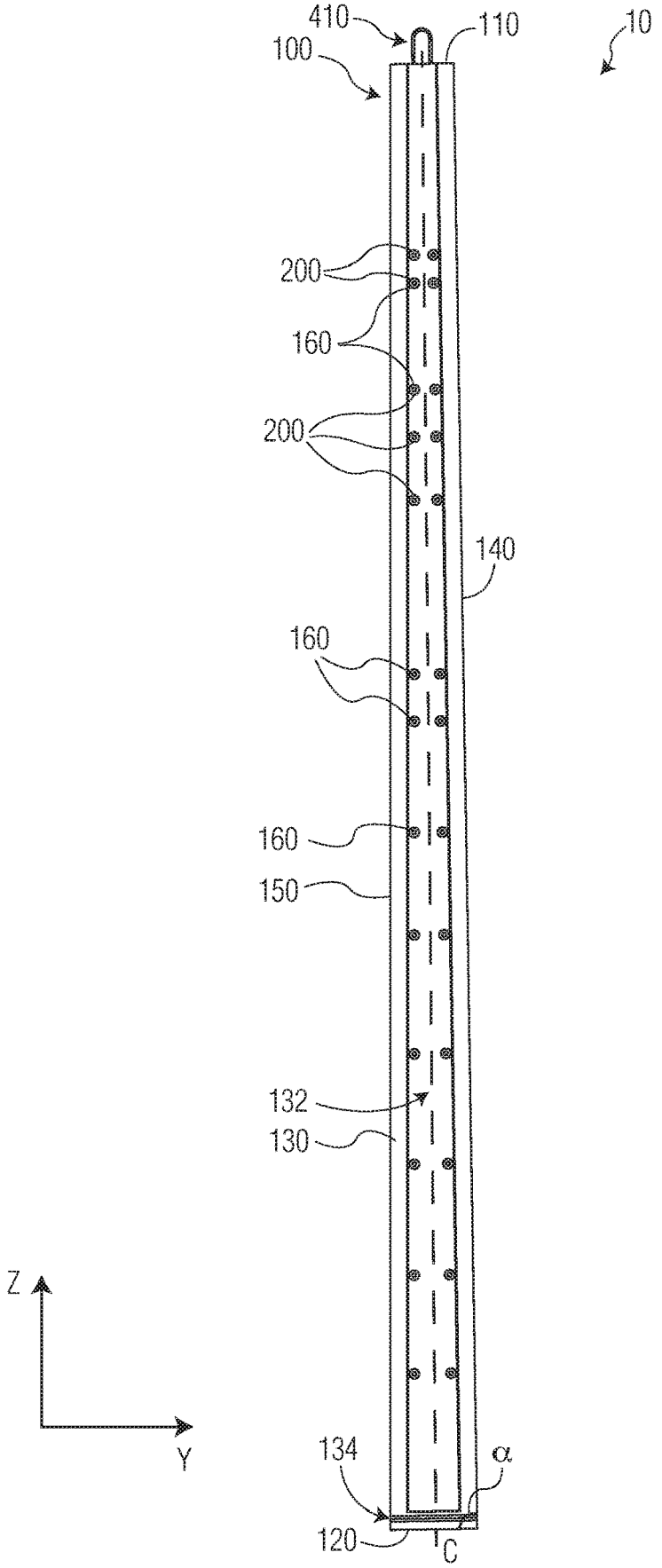
FIG. 1 is a side view of a tank wall according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will convey the concept of the disclosure to those skilled in the art. In some of the drawings, like reference numerals are omitted for some of multiple like elements in order to maintain clarity of the drawings.

A tank wall 10 according to an embodiment of the invention is shown in FIGS. 1-5. The tank wall 10, as shown in FIGS. 1-5, includes a concrete body 100, a plurality of conduits 200 disposed in the concrete body 100, a plurality of reinforcement elements 300 disposed in the concrete body 100, and a plurality of attachment elements 400 disposed in the concrete body 100.

The concrete body 100, as shown in FIG. 1, has an approximately trapezoidal prism shape with a top surface 110 and a bottom surface 120 opposite the top surface 110 in a vertical direction Z. The concrete body 100 has pair of side surfaces 130, a tapered surface 140, and a flat surface 150 extending in the vertical direction Z between the top surface 110 and the bottom surface 120.

The concrete body 100 can be formed of any mixture of cement, water, and aggregate known to those with ordinary skill in the art and used in precast concrete walls for retention structure applications. In an embodiment, the concrete body 100 is pre-cast at a location remote from a build site prior to shipping to the build site. In another embodiment, the concrete body 100 may be cast in a form at the build site before assembly into the retention structure.

As shown in FIG. 1, the flat surface 150 extends perpendicular to the top surface 110 and the bottom surface 120. In the embodiment shown in FIG. 1, the tapered surface 140 extends at an acute angle $\alpha$ with respect to the bottom surface 120. In an embodiment, the angle $\alpha$ is greater than 88° and less than 90°, and in another embodiment is between 88.5°-89.5°.

A thickness of the bottom surface 120 in a lateral direction Y perpendicular to the vertical direction Z is dictated by a maximum necessary retention strength of the tank wall 10 when used in a retention structure. In most retention structure applications, the maximum necessary retention strength is largest at the bottom of the tank wall 10 and diminishes along the vertical direction Z toward the top of the tank wall 10 as a pressure imparted by a volume of retained material retained by the retention structure decreases. The taper of the tapered surface 140 and the acute angle $\alpha$ are determined to ensure that the tank wall 10 has a necessary retention strength at each point along the vertical direction Z; the thickness of the tank wall 10 decreases in the vertical direction Z along the tapered surface 140 in correspondence with a decrease in the pressure imparted by the volume of retained material and the corresponding necessary retention strength of the tank wall 10. In an embodiment, the top surface 110 has a thickness in the lateral direction Y that is approximately 60-75% of the thickness of the bottom surface 120 in the lateral direction Y.

To cast the concrete body 100, in an embodiment, the uncured mixture is poured into a form with the flat surface 150 defining a bottom of the form and the top surface 110 and bottom surface 120 defining lateral sides of the form. The tapered surface 140 is exposed from the form during casting. A user uses a trowel to shape the tapered surface 140 to the desired dimensions. The angle α of the tapered surface 140 is sufficiently large that the concrete of the tapered surface 140 does not slump during curing. Other elements of the concrete body 100 described in greater detail below are also formed prior to curing.

Figure 2:
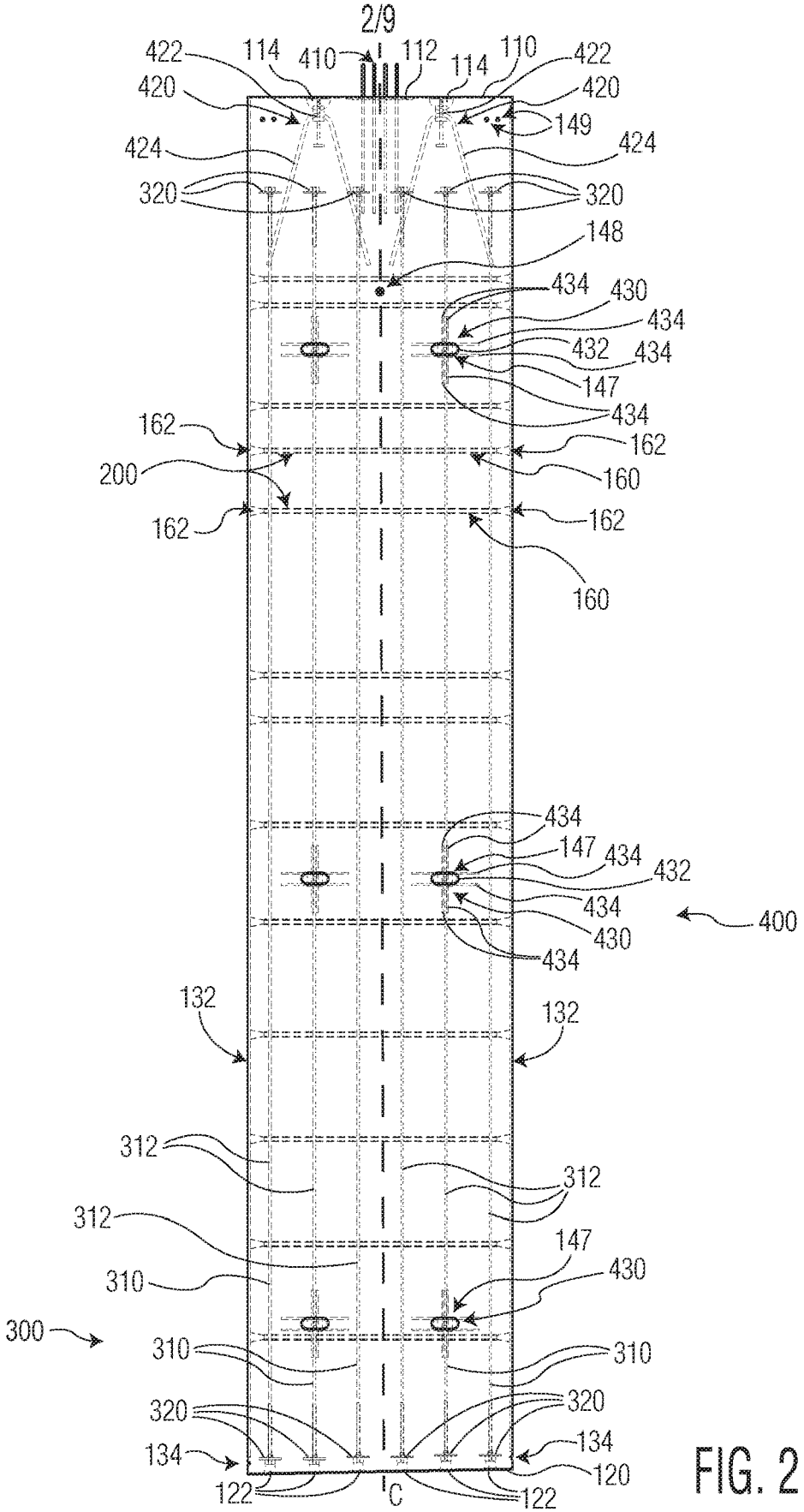
FIG. 2 is a partially sectional front view of the tank wall.
Figure 4:
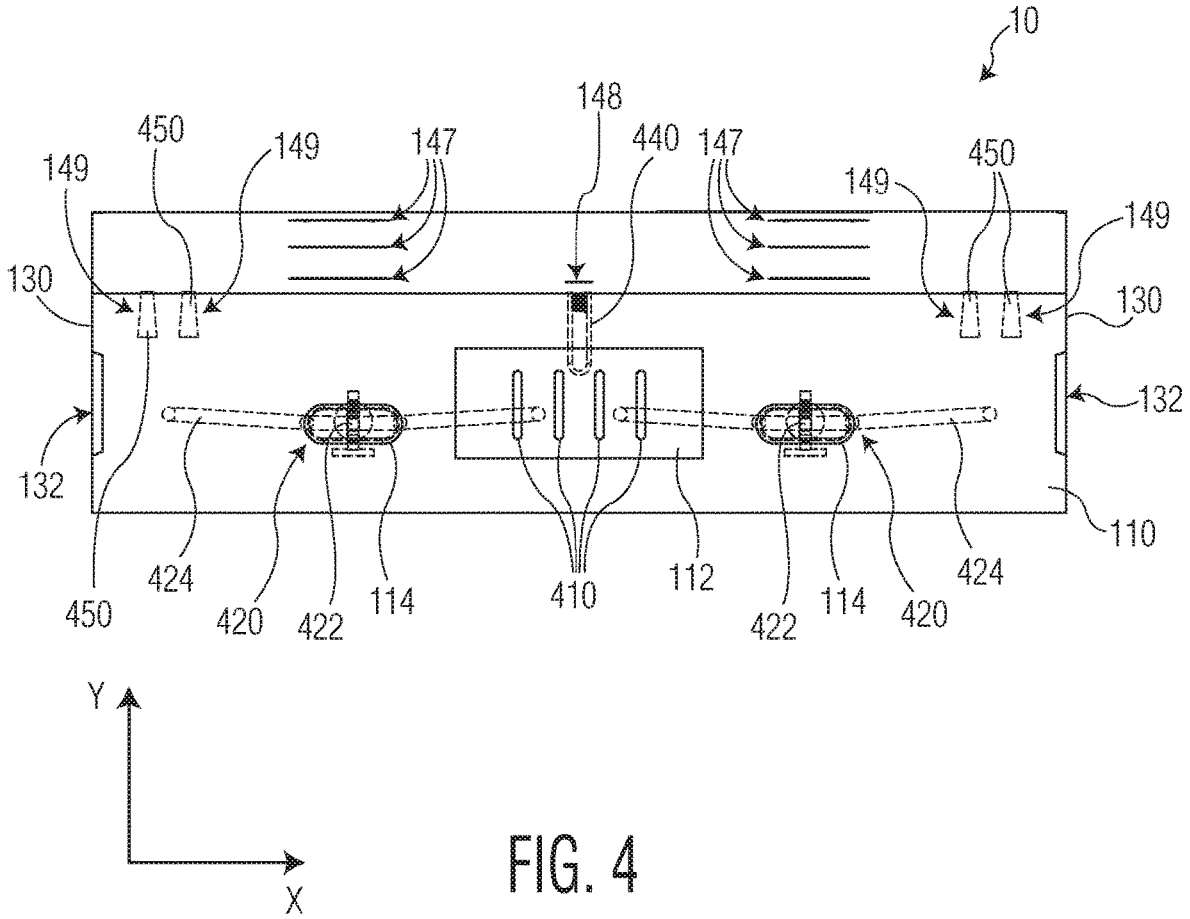
FIG. 4 is a partially sectional top view of the tank wall.

The top surface 110, as shown in FIGS. 2 and 4, has a top recess 112 and a pair of vertical anchor openings 114 extending into the top surface 110 in the vertical direction Z. The top recess 112 has an approximately rectangular shape and is disposed approximately centrally on the top surface 110 in both the lateral direction Y and a longitudinal direction X perpendicular to both the vertical direction Z in the lateral direction Y. The vertical anchor openings 114 each have an approximately oval shape and are symmetrically disposed on opposite sides of the top recess 112 in the longitudinal direction X.

Figure 3:
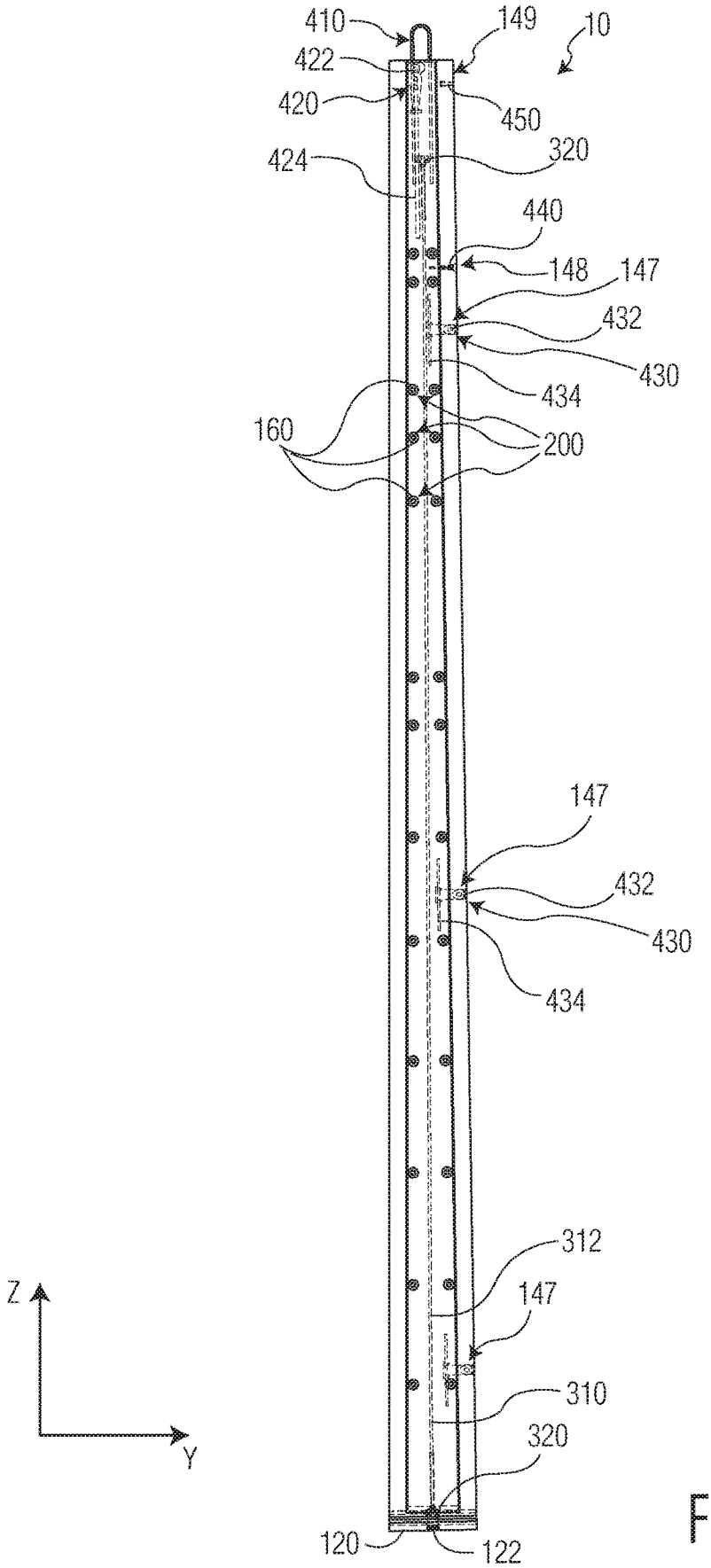
FIG. 3 is a partially sectional side view of the tank wall.

The bottom surface 120, as shown in FIGS. 2 and 3, has a plurality of reinforcement openings 122 extending into the bottom surface 120 in the vertical direction Z. In an embodiment, the reinforcement openings 122 each taper in the vertical direction Z.

Each of the side surfaces 130, as shown in FIGS. 1, 2, and 4, has a keyway 132 and a plurality of notches 134 extending into the side surface 130. The keyway 132 extends in the vertical direction Z from the top surface 110 to a position adjacent the bottom surface 120. The keyway 132 is disposed centrally in the lateral direction Y and tapers at the same angle as the tapered surface 140. The plurality of notches 134 are disposed adjacent the bottom surface 120 between the keyway 132 and the bottom surface 120 and extend in the lateral direction Y. In an embodiment, the notches 134 are each V-shaped.

The tapered surface 140, as shown in FIGS. 2-4, has a plurality of lateral anchor openings 147, a loop opening 148, and a plurality of insert openings 149 extending into the tapered surface 140 in the lateral direction Y. The lateral anchor openings 147 each have an approximately oval shape and are disposed symmetrically about a central axis C extending through the concrete body 100 in the vertical direction Z. The loop opening 148 has an approximately circular shape and is disposed on the central axis C. The insert openings 149 are each disposed adjacent the top surface 110 and symmetrically about the central axis C.

The concrete body 100, as shown in FIGS. 1-3, has a plurality of passageways 160 extending through the concrete body 100 in the longitudinal direction X. The passageways 160 extend entirely through the concrete body 100 in the longitudinal direction X and are symmetrically disposed about the central axis C. In the shown embodiment, the passageways 160 are positioned closer together in the vertical direction Z near the top surface 110 and are spaced further from one another in the vertical direction Z near the bottom surface 120. In various embodiments, the number and arrangement of passageways 160 may vary based on the application of the tank wall 10. As shown in the embodiment of FIG. 2, each of the passageways 160 has a flared end 162 disposed at each of a pair of opposite ends of the passageway 160. The flared ends 162 each widen toward an area exterior of the concrete body 100.

The conduits 200, reinforcement elements 300, and attachment elements 400 are disposed in the concrete body 100 prior to curing and will now be described in greater detail with reference to FIGS. 1-5. The particular location and number of the conduits 200, reinforcement elements 300, and attachment elements 400 within the concrete body 100 shown in the embodiment of FIGS. 1-5 is merely exemplary and will vary based on the particular application of the tank wall 10.

The conduits 200, as shown in FIGS. 1-3, are each disposed in one of the passageways 160 and extend between the flared ends 162 of the passageway 160. In the shown embodiment, each of the conduits 200 is a hollow cylindrical tube. In an embodiment, each of the conduits 200 is formed of a polyvinyl chloride ("PVC") material. In other embodiments, each of the conduits 200 may have any shape complementary to the shape of the passageways 160 and may be formed of any material suitable for use in precast concrete bodies.

Figure 5:
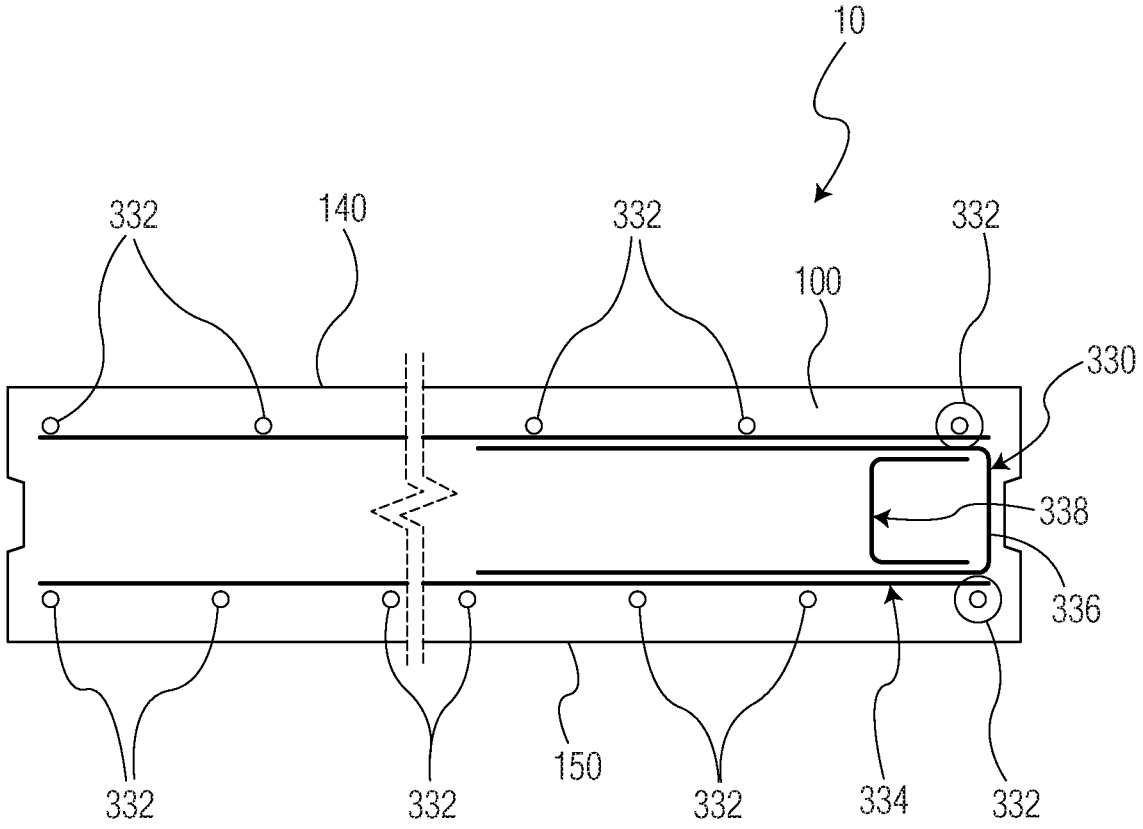
FIG. 5 is a sectional end view of the tank wall.

The reinforcement elements 300, as shown in FIGS. 2, 3, and 5 include a plurality of reinforcement strands 310, a plurality of monostrand anchors 320 to which the reinforcement strands 310 are attached, and a plurality of reinforcement bars 330.

As shown in FIGS. 2 and 3, a first set of monostrand anchors 320 are disposed adjacent the bottom surface 120 and are each accessible through one of the reinforcement openings 122. A second set of monostrand anchors 320 are disposed adjacent the top surface 110. In an embodiment, each of the reinforcement strands 310 and each of the monostrand anchors 320 is formed of a steel material. In other embodiments, each of the reinforcement strands 310 and each of the monostrand anchors 320 may be formed of any material used in precast concrete structures.

As shown in FIGS. 2 and 3, each of the reinforcement strands 310 is attached between one of the first set of monostrand anchors 320 and one of the second set of monostrand anchors 320. In an embodiment, each of the reinforcement strands 310 is surrounded by a sheathing 312 within the concrete body 100. The sheathing 312 may be formed of a plastic material. After the concrete body 100 has cured, the reinforcement strands 310 are accessed through the reinforcement openings 122 and are stressed to post-tension the concrete body 100. The monostrand anchors 320 secure the stressed reinforcement strands 310 in the concrete body 100.

As shown in FIG. 5, the reinforcement bars 330 include a plurality of vertical reinforcement bars 332, a plurality of lateral reinforcement bars 334, a plurality of first bent bars 336, and a plurality of second bent bars 338. In an embodiment, each of the reinforcement bars 330 is formed of a composite carbon-steel material. In other embodiments each of the reinforcement bars 330 may be formed of any material commonly used for reinforcement in precast concrete structures.

As shown in FIG. 5, the vertical reinforcement bars 332 extend along the vertical direction Z and are spaced apart from one another along the longitudinal direction X. The lateral reinforcement bars 334 extend along the longitudinal direction X and are spaced apart from one another along the vertical direction Z. The vertical reinforcement bars 332 and lateral reinforcement bars 334 are disposed in a grid pattern at each of the tapered surface 140 and the flat surface 150. Each of the reinforcement bars 330 may be made of a steel material.

As shown in FIG. 5, the first bent bars 336 and the second bent bars 338 are disposed aligned with each set of lateral reinforcement bars 334 at the tapered surface 140 and the flat surface 150. In the shown embodiment, the first bent bar 336 and the second bent bar 338 are disposed between the lateral reinforcement bars 334 in the lateral direction Y, and the second bent bar 338 is disposed within the first bent bar 336. In the shown embodiment, each of the first bent bar 336 and the second bent bar 338 has a U-shape.

The attachment elements 400, as shown in FIGS. 2-4, include a plurality of U-shaped bars 410, a pair of vertical anchors 420, a plurality of lateral anchors 430, a coil loop 440, and a plurality of threaded inserts 450 disposed in the concrete body 100. In other embodiments, the tank wall 10 may omit all of the attachment elements 400 or may include one or some of the U-shaped bars 410, vertical anchors 420, lateral anchors 430, coil loop 440, and threaded inserts 450.

As shown in FIGS. 2-4, the plurality of U-shaped bars 410 are disposed in the concrete body 102 to extend through the top surface 110. The U-shaped bars 410 are centrally positioned through the top surface 110 in the longitudinal direction X and extend through the top recess 112. A loop end of each of the U-shaped bars 410 is positioned outside of the concrete body 100. In an embodiment, each of the U-shaped bars 410 is formed of a composite carbon-steel material. In other embodiments each of the U-shaped bars 410 may be formed of any material commonly used for reinforcement in precast concrete structures. The shown embodiment has four U-shaped bars 410, however, the number of U-shaped bars 410 may vary in other embodiments according to the application of the tank wall 10.

The pair of vertical anchors 420, as shown in FIGS. 2-4, are disposed adjacent the top surface 110 and each include an erection anchor 422 and a vertical anchor bar 424 extending through the erection anchor 422. Each of the erection anchors 422 is positioned in the concrete body 100 such that a portion of the erection anchor 422 is exposed and accessible through one of the vertical anchor openings 114. The erection anchors 422 and the vertical anchor bars 420 may each be formed of any steel material used in precast concrete structures.

The lateral anchors 430, as shown in FIGS. 2 and 3, are dispersed in the concrete body 100 along the vertical direction Z and are disposed symmetrically about the central axis C. Each of the lateral anchors 430 includes a plate anchor 432 and a plurality of lateral anchor bars 434 contacting the plate anchor 432. Each of the plate anchors 432 is positioned in the concrete body 100 such that a portion of the plate anchor 432 is exposed and accessible through one of the lateral anchor openings 147. The lateral anchor bars 434 are positioned to extend in either the vertical direction Z or the longitudinal direction X within the concrete body 100. The plate anchors 432 and the lateral anchor bars 434 may each be formed of any steel material used in precast concrete structures.

The coil loop 440, as shown in FIGS. 3 and 4, is disposed in the loop opening 148 and is accessible from an exterior of the tank wall 10. The coil loop 440 may be formed of any steel material used in precast concrete structures.

The threaded inserts 450, as shown in FIGS. 3 and 4, are each disposed in one of the insert openings 149. In an embodiment, each of the threaded inserts 450 is formed of a plastic material.

Figure 6:
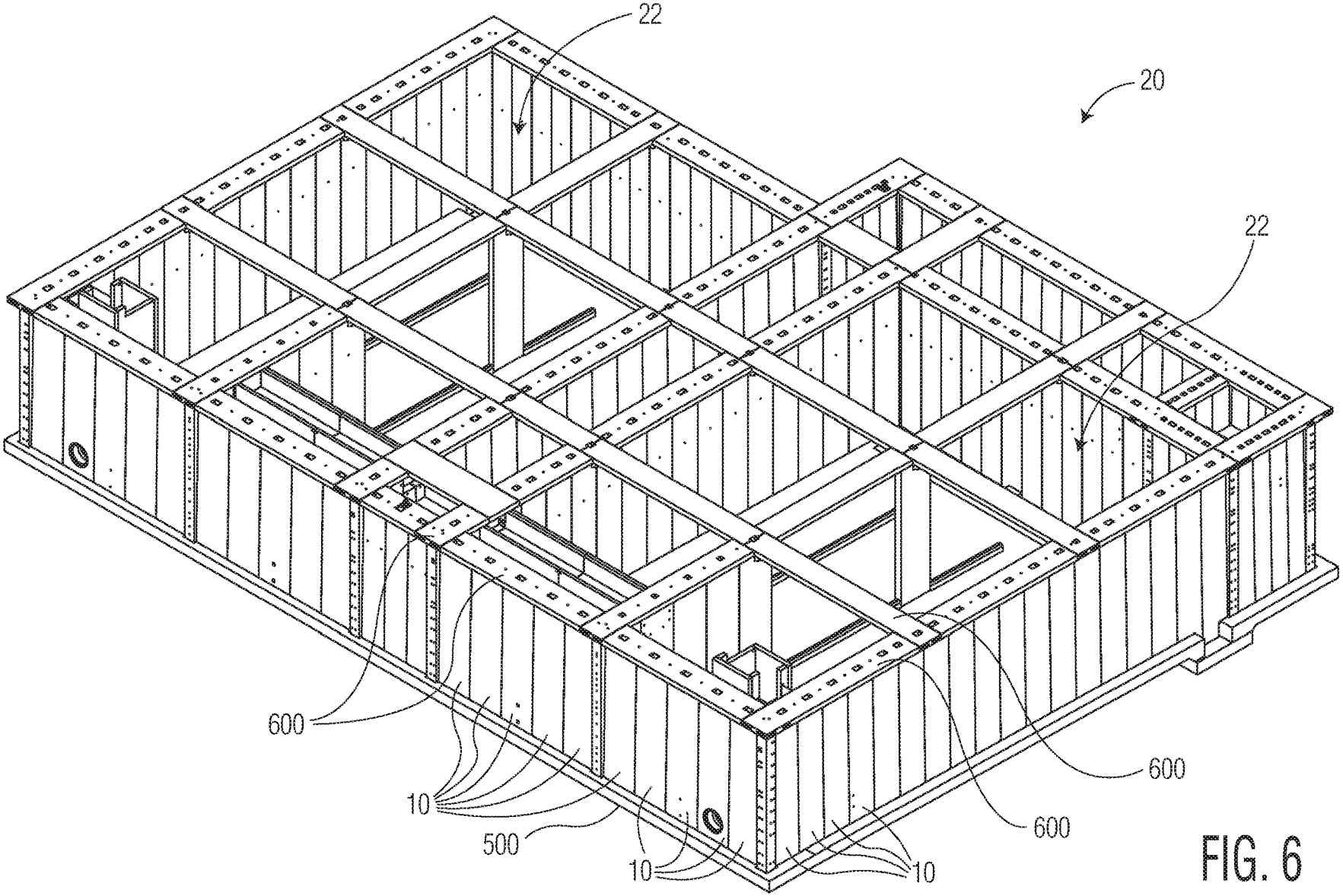
FIG. 6 is a perspective view of a retaining tank according to an embodiment.
Figure 7:
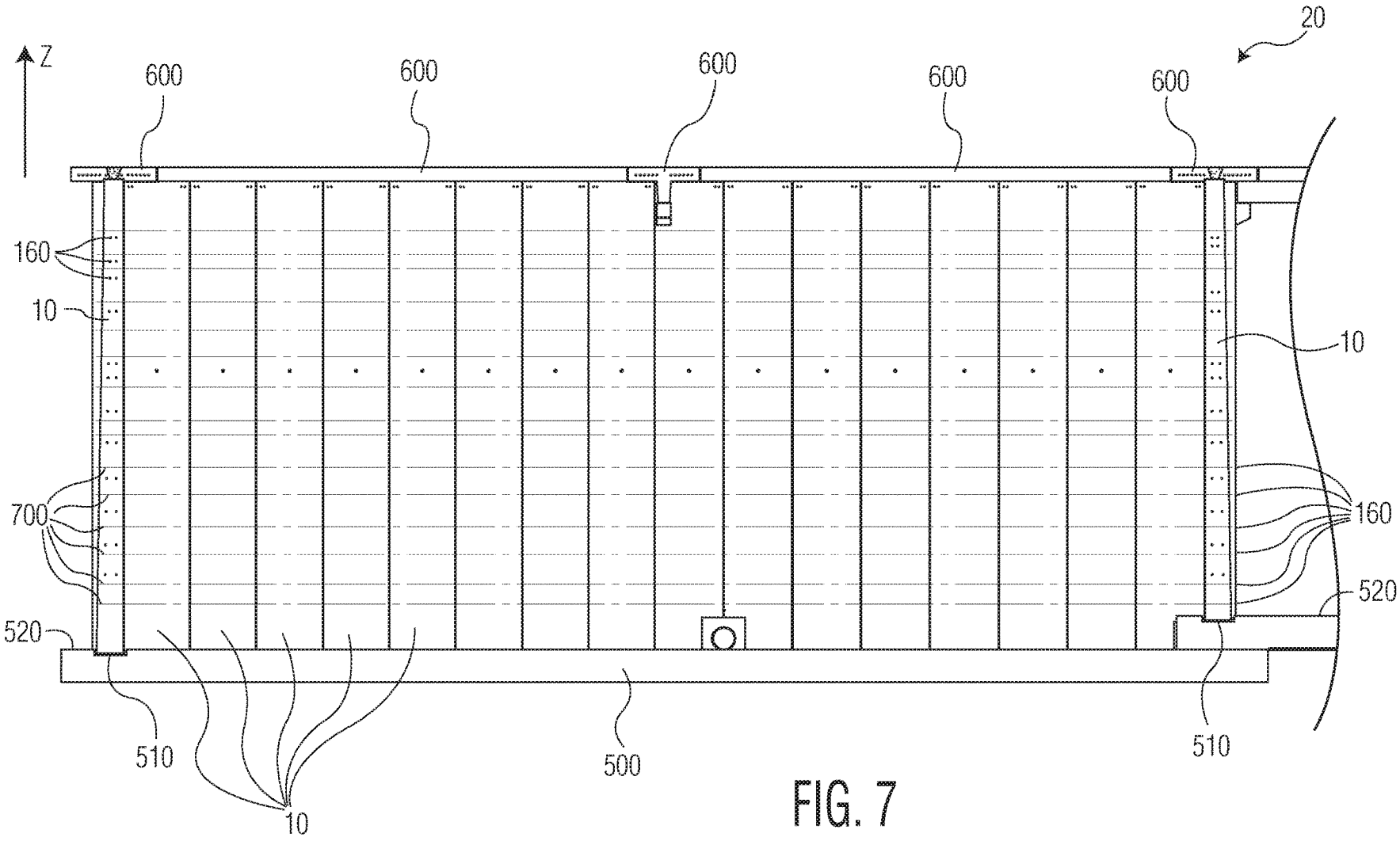
FIG. 7 is a partially sectional side view of a portion of the retaining tank.

The tank wall 10 shown in detail in FIGS. 1-5 is used to construct a retaining tank 20 shown in FIGS. 6 and 7. The retaining tank 20 and connections of the tank wall 10 to form the retaining tank 20 will now be described in detail with reference to FIGS. 6-9. In some of FIGS. 6-9, the tank wall 10 is shown schematically in order to promote clarity of the drawings.

The retaining tank 20, as shown in FIGS. 6 and 7, includes a base 500, a plurality of tank walls 10 disposed on the base 500, a plurality of walkways 600 disposed on and connected to the tank walls 10, and a plurality of reinforcement tendons 700 extending through the tank walls 10. The tank walls 10 are arranged on the base 500 to define a retention area 22 or a plurality of retention areas 22 between the tank walls 10. A material to be retained by the retaining tank 20 is disposed in the retention area 22.

The base 500 is formed of a concrete material and is cast in place at a build site of the retaining tank 20. The concrete material of the base 500 can be formed of any mixture of cement, water, and aggregate known to those with ordinary skill in the art and used in concrete bases for retention structure applications.

Figure 8:
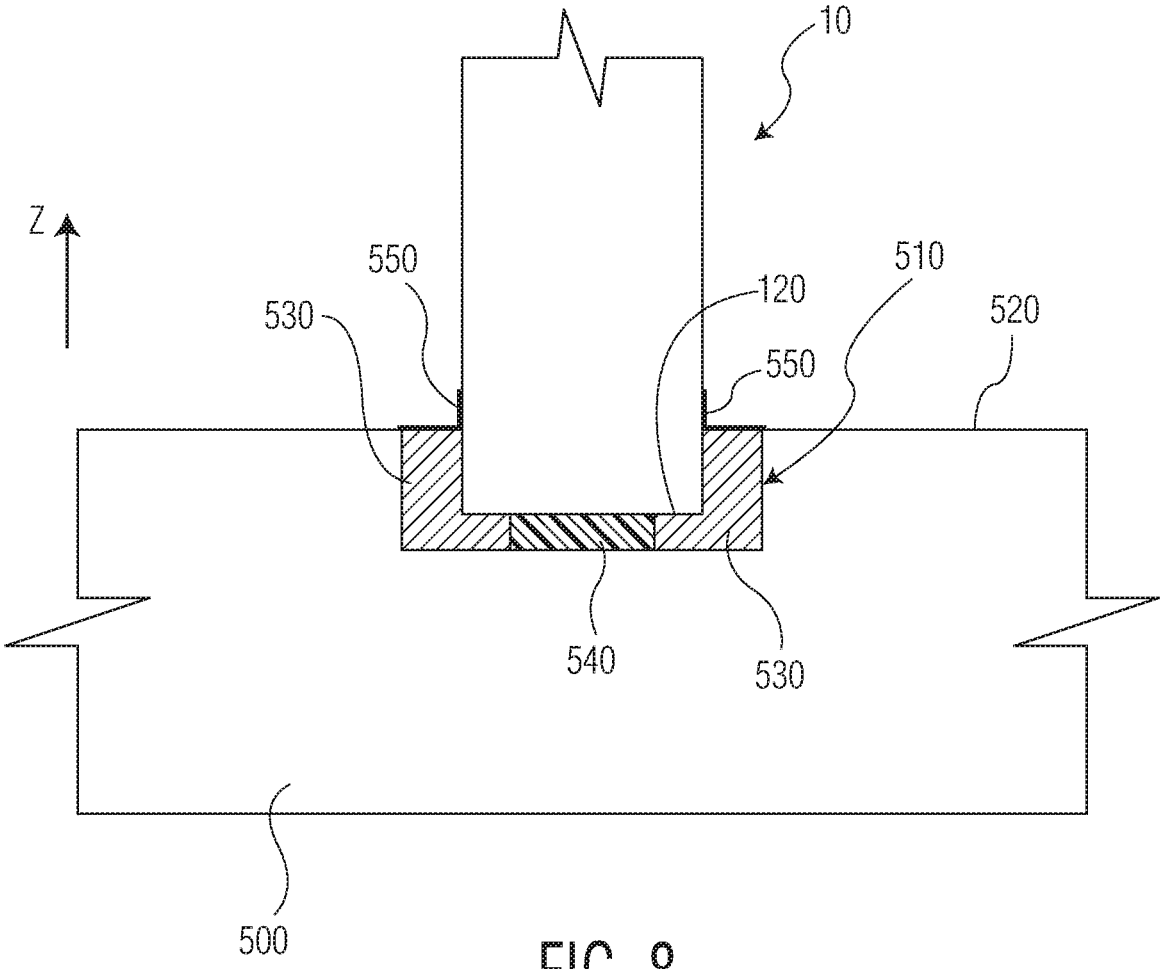
FIG. 8 is a sectional side view of the tank wall and a base of the retaining tank.

As shown in FIGS. 7 and 8, the base 500 has a plurality of base recesses 510 extending into a top surface 520 of the base 500 in the vertical direction Z. Each tank wall 10 is positioned in one of the base recesses 510 with the bottom surface 120 abutting a shim 540 positioned in the base recess 510. The tank walls 10 are each lifted and positioned by cables of a lifting device (not shown) that are connected to the vertical anchors 420, the lateral anchors 430, and the coil loop 440. These connections permit the tank wall 10 to be manipulated and properly positioned while distributing the load and avoiding damage to the concrete body 100.

As shown in FIGS. 7 and 8, with the tank wall 10 positioned in the base recess 510, a grout 530 is positioned to fill the base recess 510 and surrounds the bottom surface 120 and the shim 540. In an embodiment, the grout 530 is formed of a cement material and, in a further embodiment is formed of a non-shrink cement material. A base sealant 550 is positioned over the grout 530 and base recess 510 to seal seams between the tank wall 10 and the grout 530 and between the grout 530 and the base 500. In an embodiment, the base sealant 550 is an elastomeric material and, in a further embodiment, is formed of a polyurethane material.

Each of the walkways 600 is formed of a concrete material and is pre-cast prior to shipment to the build site of the retaining tank 20 or may be cast in a form at the build site. The concrete material of the walkway 600 can be formed of any mixture of cement, water, and aggregate known to those with ordinary skill in the art and used in concrete walkways for retention structure applications.

Figure 9:
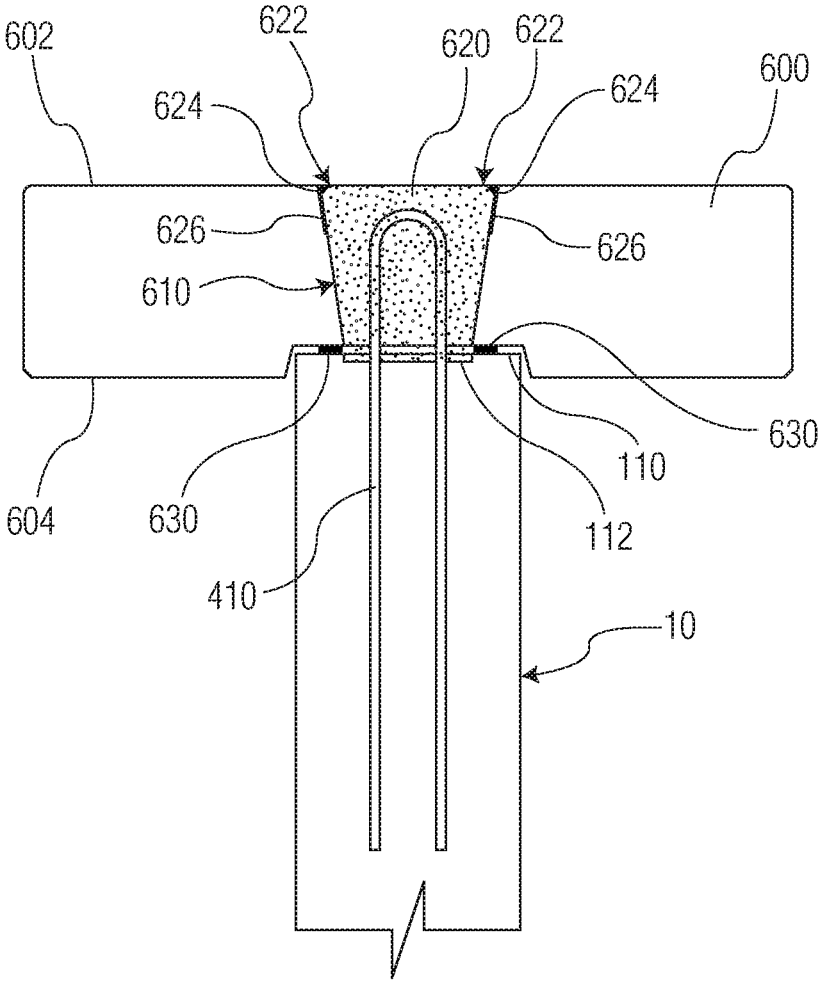
FIG. 9 is a sectional side view of the tank wall and a walkway of the retaining tank.

As shown in FIGS. 6, 7, and 9, with the tank walls 10 positioned on the base 500, each walkway 600 is attached to the tank walls 10 at the top surface 110 of the tank wall 10. Each walkway 600 is pre-cast with a plurality of cap openings 610. The U-shaped bars 410 of the tank wall 10 are all positioned to extend into one of the cap openings 610 and a cap 620 is cast in place at the build site in the cap opening 610. The cap 620 substantially fills the cap opening 610, surrounds the U-shaped bars 410, and extends into and fills the top recess 112. The cap 620 is formed of a concrete material and can be any mixture of cement, water, and aggregate known to those with ordinary skill in the art.

As shown in FIG. 9, the cap 620 is cast with rounded top edges 622 aligned with a top surface 602 of the walkway 600. A cap sealant 624 is disposed between the rounded top edges 622 and the walkway 600 and a bonding adhesive 626 is disposed between lateral sides of the cap 620 and the walkway 600. In an embodiment, the cap sealant 624 is an elastomeric material and, in a further embodiment, is formed of a polyurethane material. In an embodiment, the bonding adhesive 626 is formed of an epoxy material and bonds the cap 620 to the walkway 600.

As shown in FIG. 9, a cap barrier 630 is disposed on the top surface 110 of the tank wall 10 on opposite sides of the top recess 112. The cap barrier 630 abuts the top surface 110 and the bottom surface 604 of the walkway 600. The cap barrier 630 limits the spread of the cap 620 while the cap 620 is curing. In an embodiment, the cap barrier 630 is a foam tape.

In an embodiment, the grout 530 has a strength sufficient to support the tank wall 10; the grout 530 retains the bottom surface 120 of the tank wall 10 in the base recess 510 and the base sealant 500 forms a watertight seal between the tank wall 10 and the base 500. The connection between the tank walls 10 and the walkways 600 via the caps 620 is sufficiently strong to support the tank walls 10 to remain in an upright position in the vertical direction Z and define a structure of the retaining tank 20.

With the tank walls 10 in place on the base 500 and the walkways 600 attached to the tank walls 10, the reinforcement tendons 700 are positioned and tensioned to form the finished retaining tank 20. In an embodiment, each of the reinforcement tendons 700 is formed of a steel material and, in other embodiments, may be formed of any material used for tensioning reinforcement in precast concrete structures. As shown in FIG. 7, each of the reinforcement tendons 700 is positioned to extend through the passageways 160, and through the conduits 200, of a plurality of adjacent tank walls 10. The reinforcement tendons 700 are then tensioned and secured to place each section of the retaining tank 20 that includes a plurality of tank walls 10 under tension to meet the strength requirements of the retaining tank 20. The tensioning of the reinforcement tendons 700 may occur before or after the grout 530 is filled in the base recesses 510.

In the tank wall 10 according to the present invention, the tapered surface 140 makes it possible to meet the maximum retention strength requirement at the bottom of the tank wall 10 while limiting an overall quantity of concrete used to form the concrete body 100. Limiting the quantity of concrete with the tapered surface 140 lowers the material cost of the retaining tank 20 while also lowering a weight of the tank wall 10 or permitting the tank wall 10 to be larger in the longitudinal direction X for a given weight. Therefore, more tank walls 10 can be shipped in each shipment to the build site, further lowering shipping costs and increasing efficiency of the construction of the retaining tank 20. Additionally, the base 500 and walkways 600 form a watertight seal of the bottom of each tank wall 10 while creating a more reliable securing of the tank wall 10 at each of the top and bottom of the tank wall 10.

What is claimed is:

1. A tank wall, comprising:

a concrete body having a top surface, a bottom surface opposite the top surface in a vertical direction, a flat surface extending in the vertical direction between the top surface and the bottom surface, and a tapered surface disposed opposite the flat surface and extending in the vertical direction between the top surface and the bottom surface, the flat surface extends perpendicular to the bottom surface and a portion of the tapered surface extends at an acute angle with respect to the bottom surface, the concrete body has a pair of side surfaces extending in the vertical direction between the top surface and the bottom surface, each of the side surfaces has a keyway extending in the vertical direction from the top surface to a position adjacent the bottom surface and a plurality of notches disposed adjacent the bottom surface between the keyway and the bottom surface;

a plurality of reinforcement elements disposed in the concrete body and including a plurality of reinforcement strands and a plurality of monostrand anchors between which the reinforcement strands are attached; and a plurality of attachment elements disposed in the concrete body and including a plurality of U-shaped bars extending through the top surface of the concrete body, each of the U-shaped bars has a loop end positioned outside of the concrete body.

2. The tank wall of claim 1, wherein the plurality of reinforcement elements include a plurality of reinforcement bars with a plurality of vertical reinforcement bars and a plurality of lateral reinforcement bars disposed in a grid pattern at each of the tapered surface and the flat surface.

3. The tank wall of claim 2, wherein the plurality of reinforcement elements include a plurality of first bent bars and a plurality of second bent bars aligned with the lateral reinforcement bars and disposed between the lateral reinforcement bars.

4. The tank wall of claim 1, wherein a thickness of the top surface in a lateral direction perpendicular to the vertical direction is 60-75% of a thickness of the bottom surface in the lateral direction.

5. The tank wall of claim 1, wherein the concrete body has a plurality of passageways extending through the concrete body in a longitudinal direction perpendicular to the vertical direction.

6. The tank wall of claim 5, further comprising a plurality of conduits, each of the conduits is a hollow cylindrical tube positioned in one of the passageways.

7. The tank wall of claim 1, wherein the concrete body has a plurality of reinforcement openings extending into the bottom surface in the vertical direction, a set of the monostrand anchors is accessible through the reinforcement openings.

8. The tank wall of claim 7, wherein the reinforcement strands are accessed through the reinforcement openings and are stressed to post-tension the concrete body.

9. The tank wall of claim 8, wherein a sheathing is disposed in the concrete body around each of the reinforcement strands.

10. The tank wall of claim 1, wherein the attachment elements include a pair of vertical anchors disposed adjacent the top surface.

11. The tank wall of claim 10, wherein each of the vertical anchors includes an erection anchor exposed through a vertical anchor opening in the top surface and a vertical anchor bar extending through the erection anchor.

12. The tank wall of claim 10, wherein the attachment elements include a plurality of lateral anchors dispersed in the concrete body along the vertical direction.

13. The tank wall of claim 12, wherein each of the lateral anchors includes a plate anchor exposed and accessible through a lateral anchor opening in the tapered surface and a plurality of lateral anchor bars contacting the plate anchor.

14. The tank wall of claim 12, wherein the attachment elements include a coil loop disposed in a loop opening in the tapered surface and accessible from an exterior of the concrete body.

15. The tank wall of claim 14, wherein the attachment elements include a plurality of threaded inserts each disposed in an insert opening of the tapered surface.

16. A retaining tank, comprising:

a base;

a plurality of tank walls disposed on the base, each of the tank walls including:

a concrete body having a top surface, a bottom surface opposite the top surface in a vertical direction, a flat surface extending in the vertical direction between the top surface and the bottom surface, and a tapered surface disposed opposite the flat surface and extending in the vertical direction between the top surface and the bottom surface, the flat surface extends perpendicular to the bottom surface and a portion of the tapered surface extends at an acute angle with respect to the bottom surface;

a plurality of reinforcement elements disposed in the concrete body and including a plurality of reinforcement strands and a plurality of monostrand anchors between which the reinforcement strands are attached; and a plurality of attachment elements disposed in the concrete body and including a plurality of U-shaped bars extending through the top surface of the concrete body, each of the U-shaped bars has a loop end positioned outside of the concrete body; and a plurality of walkways disposed on and connected to the tank walls.

17. The retaining tank of claim 16, wherein the concrete body and the walkways are pre-cast remote from a build site of the retaining tank and the base is cast in place at the build site.

18. The retaining tank of claim 17, wherein the base has a plurality of base recesses each extending into a top surface of the base, each tank wall is positioned in one of the base recesses.

19. The retaining tank of claim 18, wherein the bottom surface of the tank wall abuts a shim positioned in the base recess and a grout is positioned to fill the base recess and surround the bottom surface of the tank wall and the shim.

20. The retaining tank of claim 19, wherein the grout and a base sealant disposed over the base recess form a watertight seal between the tank wall and the base.

21. The retaining tank of claim 20, wherein each of the walkways has a plurality of cap openings, the U-shaped bars of one of the tank walls are positioned to extend into one of the cap openings.

22. The retaining tank of claim 21, further comprising a cap disposed to substantially fill the cap opening and surround the U-shaped bars.

23. The retaining tank of claim 22, wherein the cap is formed of a concrete material and cast in place at the build site.

24. The retaining tank of claim 23, wherein the cap has a plurality of rounded top edges aligned with a top surface of the walkway and a cap sealant is disposed between the rounded top edges and the walkway.

25. The retaining tank of claim 24, wherein a bonding adhesive is disposed between a pair of lateral sides of the cap and the walkway.

26. The retaining tank of claim 24, wherein a cap barrier is disposed on the top surface of the tank wall on opposite sides of the cap and abuts a bottom surface of the walkway.

27. The retaining tank of claim 23, wherein each of the tank walls has a plurality of passageways extending through the concrete body in a longitudinal direction perpendicular to the vertical direction.

28. The retaining tank of claim 27, further comprising a plurality of reinforcement tendons each positioned to extend through one of the passageways in each of the plurality of tank walls.

29. The retaining tank of claim 28, wherein the reinforcement tendons are tensioned and secured to place the plurality of tank walls under tension.

30. The retaining tank of claim 16, wherein each of the walkways has a plurality of cap openings, the U-shaped bars of one of the tank walls are positioned to extend into one of the cap openings.

* * * * *